US005987835A

United States Patent [19]

Santarossa

[11] Patent Number: 5,987,835

[45] Date of Patent: Nov. 23, 1999

[54] EXTERIOR INSULATING FINISH PANEL SYSTEM

[76] Inventor: Ned Santarossa, 281 Applewood Crescent, Concord, Ontario, Canada, L4K 4B4

[21] Appl. No.: 08/805,200

[22] Filed: Feb. 27, 1997

[51] Int. Cl.[6] ..... E04B 2/08

[52] U.S. Cl. ..... 52/417; 52/309.8; 52/506.05; 52/592.1; 52/592.6

[58] Field of Search ..... 52/287.1, 309.8, 52/309.14, 309.17, 460, 591.1, 592.1, 592.6, 742.16, 745.1, 747.12, 506.01, 506.05, 417

[56] References Cited

U.S. PATENT DOCUMENTS

| | | | |
|---|---|---|---|
| 335,342 | 2/1886 | Daugherty | 52/592.6 X |
| 1,116,202 | 11/1914 | Assip | 52/592.6 X |
| 1,692,438 | 11/1928 | Gates | 52/591.1 X |
| 3,350,827 | 11/1967 | Sugar | 52/742.16 X |
| 4,299,069 | 11/1981 | Neumann | 52/309.4 |
| 4,388,361 | 6/1983 | Vassalli | 52/592.6 X |
| 4,608,795 | 9/1986 | Neuschaeffer et al. | 52/591.1 X |
| 4,774,794 | 10/1988 | Grieb | 52/309.17 X |
| 5,636,489 | 6/1997 | Leverrier et al. | 52/309.8 X |
| 5,649,398 | 7/1997 | Isley, Jr. et al. | 52/309.17 |

*Primary Examiner*—Michael Safavi
*Assistant Examiner*—Kevin D. Wilkens
*Attorney, Agent, or Firm*—Paul Field

[57] ABSTRACT

A method of cladding a building wall surface with individual prefabricated panels and trim mouldings with any fasteners and joints between the panels and trim being covered on site with a coating of stucco to produce a flush finished stucco surface. Each panel has a uniform transverse cross-sectional profile, and a core of foam material coated with a weather-proof stucco coating on its exterior surface. Tongue and groove joints are disposed along the longitudinal surfaces and a longitudinal recess in the exterior surface adjacent each tongue and groove joint is adapted to receive a layer of joint coating to fill the recess and cover the longitudinal joints flush with the external surface. The wall surface is installed by cutting the elongate cladding panels to the approximate length of the wall and mounting the cladding panels temporarily to the wall substrate, such as plywood for example. The exterior surface of the panels is aligned to a predetermined outside finish datum and fasteners secure the cladding panels to the substrate without creating a thermally conductive bridge between the substrate and the external ambient atmosphere. The openings around doors and windows, vertical corners and other details are finished by cutting, mounting and affixing elongate transverse end trim mouldings to cover the end surfaces of the cladding panels. Installation is completed by applying a joint coating to cover the joints and filling the adjacent recesses flush with the exterior surface of the panels, then applying a final finish coat to the entire wall assembly.

5 Claims, 8 Drawing Sheets

EXTERIOR INSULATING FINISH PANEL SYSTEM

TECHNICAL FIELD

The invention is directed to an exterior insulating finish panel system and method of construction, particularly a modular system to produce a completely finished stucco exterior cut from stock lengths of factory produced moulded components.

BACKGROUND OF THE ART

Exterior finishing systems for building constructions include brick or masonry, aluminum siding, wooden siding, sheet metal panels, and stucco. The popularity of stucco finishes has recently increased partially due to the introduction of prefinished moulding components, prefabricated panels and other stucco finished components which have an insulating foam core coated with weatherproof coating.

Stucco finishes have traditionally been associated with the architectural styles of southern Europe, South and Central America and other relatively warm climates, however, modern stucco products have been used in northern climates as well with equal success. In Canada and the northern United States traditionally buildings have been clad with brick, metal or wood siding, although stucco finishes are on the increase.

The widespread adoption of stucco construction has been inhibited largely due to the relatively high cost and short summer period in northern climates. Stucco finishing requires highly skilled labour and dry warm weather due to the conventional practice of applying the entire multiple layer stucco coating by hand on site. Typically, stucco mouldings are affixed to a concrete block or wooden wall, a reinforcing mesh is then applied to the wall, a coarse base layer of stucco and then one or two finish coats of fine stucco are applied by hand.

To reduce the labour component, prefabricated and precoated stucco panels and moulding have been provided, however, conventional methods still require the entire surface to be finish stucco coating to be applied by hand on site. The appearance of the final coating is critical to the overall result and so highly skilled workers are required to ensure consistent colour, thickness, finish roughness etc. Since moulding, panels and other prefinished components may have slightly different exterior coloured or textured finishes, it is common to integrate all components visually by applying the final finish coating of stucco on site.

As a result of the high labour content involved in stucco finishing, other conventional finishes are largely preferred by builders, such as brick and siding. The brick and metal siding come to the site usually in a completely finished state requiring only cutting and installation to produced a complete exterior finish. The level of skill is lower than stucco, and the methods of construction are generally familiar to workers. For these reasons, small scale projects done by individual property owners or small contractors don't often include stucco, but rather tend to include wooden or metal siding which do not require the same skill or tools.

Never the less, architects and owners often prefer the appearance of stucco, and wish to benefit from some of its advantages. Stucco is very easily integrated with other finishes and is relatively lightweight. By including a layer of foam in the prefabricated stucco coated panels and mouldings, a significant degree of insulating value can be easily added. These advantages result in stucco use in many renovation or addition projects. Stucco also gives a modern clean and stylish impression whereas metal or wood siding appears on relatively low cost housing, and projects an associated image.

Stucco is the traditional method of exterior finishing in many southern climates, partly due to the relatively high cost of alternative finish materials such as wood or metal in those parts of the world. In contrast, stucco uses much less expensive materials, such as sand and cement. Even in southern markets, the speed of traditional stucco finishing and labour intensive methods involved result in significant construction costs and time involved.

Stucco cannot be properly applied in wet weather except in a sheltered enclosure and requires a period of time in relatively warm air after application to cure properly. Stucco is applied as a wet cement mixture and therefore cannot be applied in freezing weather or heavy rain. Scaffolding is required to gain access to the wall to be coated with traditional stucco, and to store materials. The cost of heating stucco after application to prevent freezing overnight renders the acceptance of stucco limited especially in colder climates.

Conventional prefabricated panels in part address these problems by providing a partially finished panel which is final finish coated on site. However in many southern climates, labour is still relatively cheap compared to the costs of factory prefabrication and transport of materials to a building site. As a result, the adoption of prefabricated panels has not penetrated beyond large volume building construction projects such as hotels, commercial and industrial buildings. Homes coated with stucco remain largely built with traditional labour intensive methods and locally available materials.

It is desirable therefore to produce a finished stucco finish by methods which reduce the level of skill and the time involved.

It is also desirable to produce stucco finishes with a final cost competitive with conventional finishing systems, including traditionally installed stucco, brick, wood or metal siding.

It is desirable to produce a lightweight durable stucco building product which is simple to understand, uses commonly available tools and building methods, so that relatively unskilled people, such as do-it-yourself homeowners or those in developing countries, can easily complete a project.

It is also desirable to produce a stucco product which is substantially finished to reduce on site labour and can be installed in various weather conditions, without specialized tools or complex installation methods.

DISCLOSURE OF THE INVENTION

The invention provides a novel exterior insulating finish cladding panel having: an exterior surface; an interior surface; first and second longitudinal side surfaces; and first and second end surfaces, the panel having a uniform transverse cross-sectional profile and a core of foam material coated with a weatherproof coating on at least the exterior surface; tongue and groove joint means, disposed along at least one of the longitudinal surfaces, for joining the panel to a like adjacent panel in a longitudinal joint; and a longitudinal recess in the exterior surface adjacent each said tongue and groove joint means adapted to receive a layer of joint coating to fill the recess and cover said longitudinal joint flush with said external surface.

Also in accordance with the invention is provided an exterior insulating finish panel system, comprising: a plurality of elongate panels, each panel having: an exterior surface; an interior surface; first and second longitudinal side surfaces; and first and second end surfaces, each panel having a uniform transverse cross-sectional profile and a core of foam material coated with a weatherproof coating on at least the exterior surface; tongue and groove joint means, disposed along the longitudinal surfaces, for joining each panel to a like adjacent said panel in a plurality of longitudinal joints; and a longitudinal recess in the exterior surface adjacent each said tongue and groove joint means adapted to receive a layer of joint coating to fill the recess and cover said longitudinal joints flush with said external surface; and fastening means for mounting the cladding panels to a substrate without creating a thermally conductive bridge between the substrate and the external ambient atmosphere.

Further, the invention provides a method of cladding a building wall surface comprising the steps of: cutting a plurality of elongate cladding panels to the approximate length of the wall surface, each panel having: an exterior surface; an interior surface; first and second longitudinal side surfaces; and first and second end surfaces, each panel having a uniform transverse cross-sectional profile, and a core of foam material coated with a weatherproof coating on at least the exterior surface; tongue and groove joint means, disposed along the longitudinal surfaces, for joining the panel to a like adjacent panel in a longitudinal joint; and a longitudinal recess in the exterior surface adjacent each said tongue and groove joint means adapted to receive a layer of joint coating to fill the recess and cover said longitudinal joints flush with said external surface; and mounting the cladding panels temporarily to a substrate, and aligning the exterior surface of the panels to a predetermined outside finish datum; affixing fastening means to secure the cladding panels to the substrate without creating a thermally conductive bridge between the substrate and the external ambient atmosphere; cutting, mounting and affixing a plurality of elongate transverse end trim mouldings to overlap each of the end surfaces of said cladding panels, said moulding means having a uniform transverse cross-sectional profile, and a core of foam material coated with a weatherproof coating on at least an exterior thereof; and applying a joint coating to cover said joint and filling said adjacent recesses flush with the exterior surface of the panels.

The panels are quickly installed and assembled together with interlocking tongue and groove longitudinal edges, similar to wooden siding. To result in a flush invisible finished joint, panels include a longitudinal recess in the exterior surface adjacent each longitudinal side surface. On site joint finishing includes the steps of affixing a longitudinal strip of joint reinforcing mesh spanning across the tongue and groove joint within the adjacent recesses of adjacent panels and applying a joint coating to cover joint mesh and filling the adjacent recesses. The recessed joining method produces a flush joint which is not visible after finishing, and produces a flat stucco wall.

The panels are provided to the building site in stock lengths and cut with an ordinary saw, like wood or metal siding. Screwdrivers are used to attach the panels with screws and self countersinking plastic washers to the building. Trim moulding components also with a stucco finish abut the cut panel ends and edges at windows, doors and corners of the building. Adhesives and caulking provide further securing means and a weathertight seal. Longitudinal tongue and groove joints with a recessed taped and troweled flush joints, and snug abutting of trim moulding ensure preservation of insulating values in the range of over R8. Expansion joints between rows of panels are provided to accommodate expected expansion and contraction.

The panels and moulding are supplied completely finished preferably with three coats of stucco and reinforcing mesh over a foam core. Since a tongue and groove joint is used, little on site finishing is required and therefore the system can be substantially installed in any weather, cold or wet. When weather permits, taped and troweled joints are completed, the on site stucco finishing is substantially reduced over conventional methods, since only the joints need be finished. Commonly available carpentry tools and widely known carpentry skills are all that is required. The completely finished modular components can be adapted on site to cover any building surface.

Since the panels and moulding have a lightweight foam core ladders may be used for the bulk of installation. Use of scaffolding is substantially reduced. The foam core provides insulation value and renders the system lightweight enough to use on dormers, second floor additions, and renovation projects without requiring extensive reinforcing of lower supporting levels.

The use of stucco panels systems according to the invention is expected to compete in the market with metal and wood siding which uses similar tools and skills. Stucco panels provide the added advantage that repairs are easily completed by applying a layer of fresh stucco. The form core of stucco panels does not deteriorate like wood siding which can rot and requires continual repainting. Metal siding that is dented simply cannot be repaired adequately and must be replaced. Traditional stucco is relatively expensive as described above. The raw materials used in the panel system are low cost compared to wood or metal.

Mass production of standard modular components, together with the reduced skill level required, result in dramatically reduced costs. It is anticipated that the invention will be produced at installed costs low enough to be included in low cost housing, housing in developing countries and in home improvement projects by do-it-yourself owners or small volume building contractors. Panels and trim modular components are resilient, easily handled and transported, and can be quickly repaired with fresh stucco if damaged in transit.

The light weight of the system provides the option of mass producing panels and trim moulding at a central facility and shipping in containers to remote sites, commercial sales outlets or distant countries. Distribution and manufacturing of many conventional building materials follows a similar route to market. Economies of scale and transferring the skill from the construction site to the factory will inevitably reduce costs.

In comparison to the invention, conventional brick surfaces have high transport costs, significant on site labour costs and delays, and high energy consumption in manufacturing. Traditional stucco has high labour costs and installation delays due to weather. Wood and metal siding are easily damaged in transport and installation with no viable means for repair. Wood siding deteriorates rapidly with age and is not cost effective outside of major lumber producing areas such as North America and northern Europe.

Further details of the invention and its advantages will be apparent from the detailed description and drawings included below.

BRIEF DESCRIPTION OF THE DRAWINGS

In order that the invention may be readily understood, a preferred embodiments of the invention will be described by way of example, with reference to the accompanying drawings wherein.

DETAILED DESCRIPTION OF PREFERRED EMBODIMENTS

Figure 1:
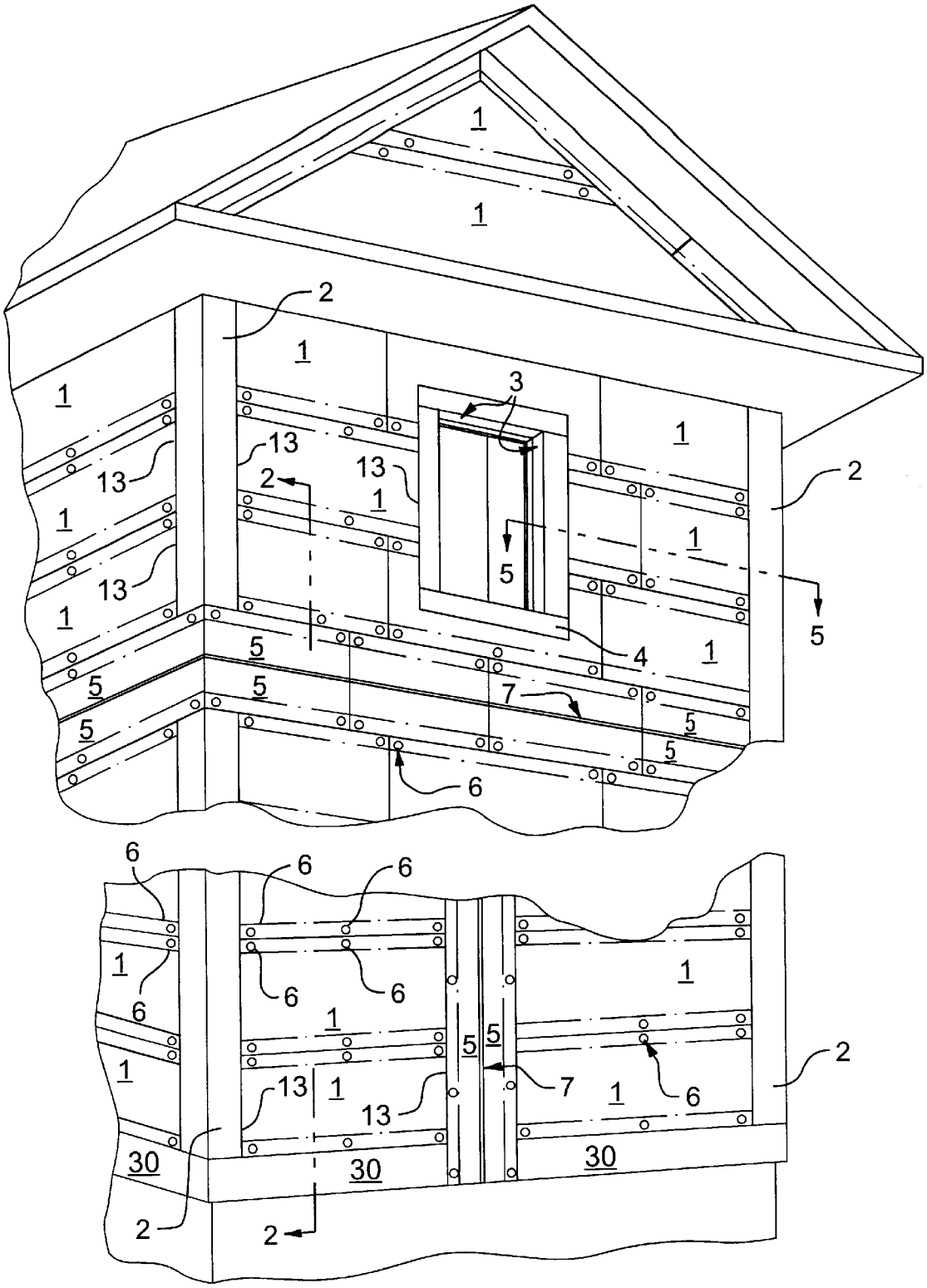
FIG. 1 is an isometric view of a building wall clad with panels and trim moulding of the invention, including a vertically stacked array of cladding first panels with tongue and groove joints, outside corner end trim mouldings, bottom starter strip, expansion joints and window trim mouldings, all providing a completely finished stucco appearance.

With reference to FIG. 1, a first preferred embodiment of the invention is illustrated providing an exterior insulating finish panel surface on a building wall. The invention provides a modular system to produce a completely finished stucco exterior cut from stock lengths of moulded components.

The system illustrated in FIG. 1 uses tongue and groove joining means along the longitudinal sides of each panel for rapid and accurate installation. On site finishing includes applying a mesh in the recessed joint area and filling with a joint compound to produce an finished invisible joint.

Elongate panels 1 are attached to the building wall substrate in a vertically stacked array. The cut ends of the panels 1 are abutted against closely fitting transverse trim mouldings, such as the outside corner moulding 2, window frame moulding 3, and window ledge moulding 4, as shown. It will be understood that the invention can be adapted to provide any panel and trim configuration specified for architectural effect. For example, the edge and window trim shown produces a simple flat surface, however, profiled trim sections can be used to equal advantage to include any desired architectural features.

Figure 2:
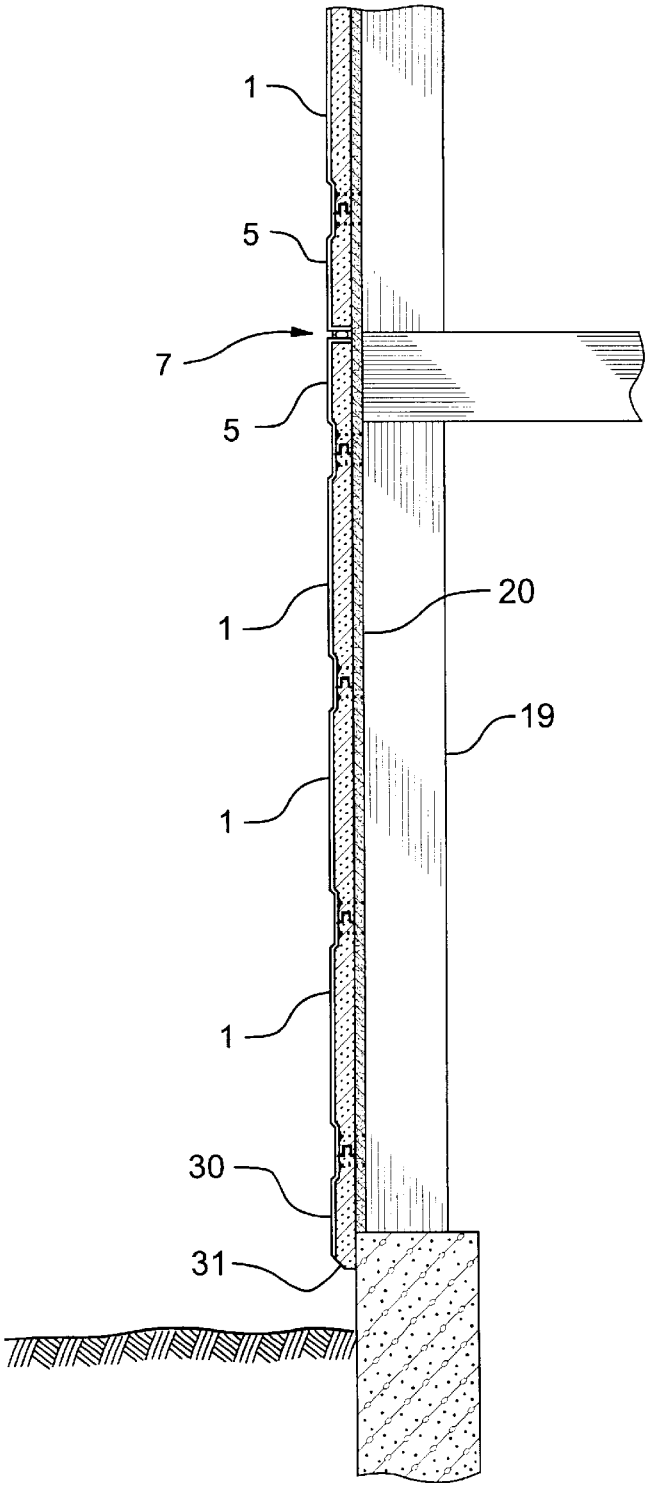
FIG. 2 is a sectional elevation view through the panels showing the interlocking recessed tongue and groove joint, and expansion joint along line 2—2 of FIG. 1.
Figure 5:
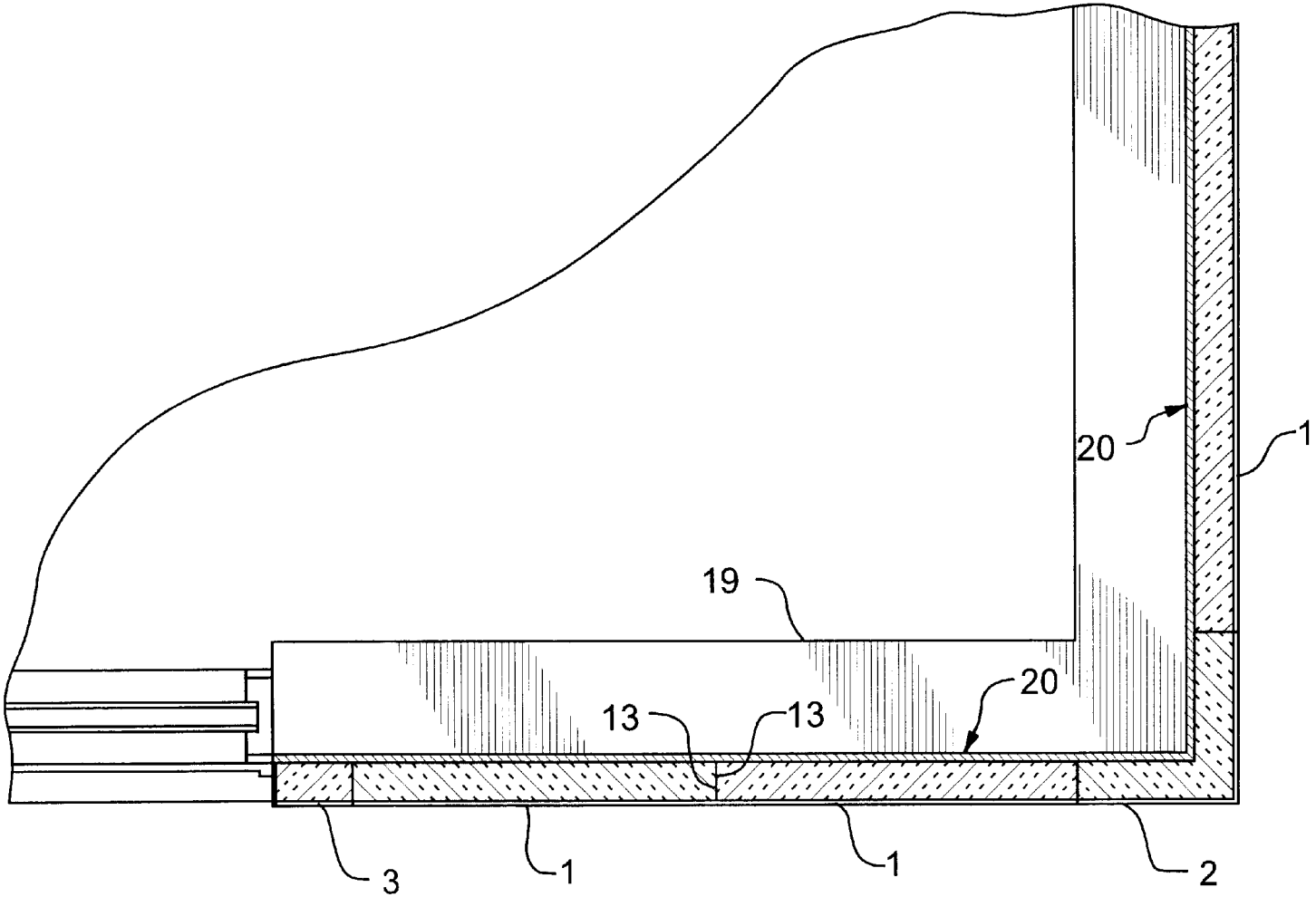
FIG. 5 is a sectional plan view though the panels and end trim mouldings showing the abutting of the cut panel end portions moulding around windows and at outside corners along line 5—5 of FIG. 1.
Figure 6:
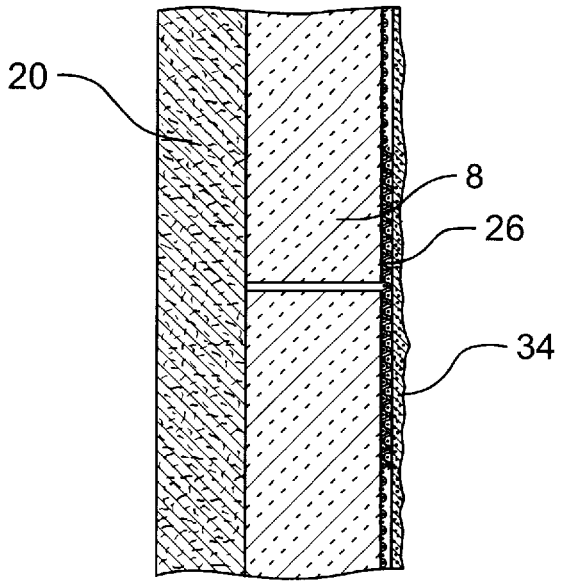
FIG. 6 is a detail view of the vertical abutting joint of FIG. 5 between two panel ends, finished on site with mesh and joint compound.

Briefly summarized, FIG. 2 shows a sectional view of an assembled array of panels 1 with interlocking tongue and groove longitudinal edges. Means to fasten the panels 1 to a building substrate include adhesives and/or screws 6. FIG. 5 shows a horizontal sectional view through the wall, illustrating the relationship of the ends of the panels 1 and the abutting corner moulding 2 and window frame trim 3

Figure 8:
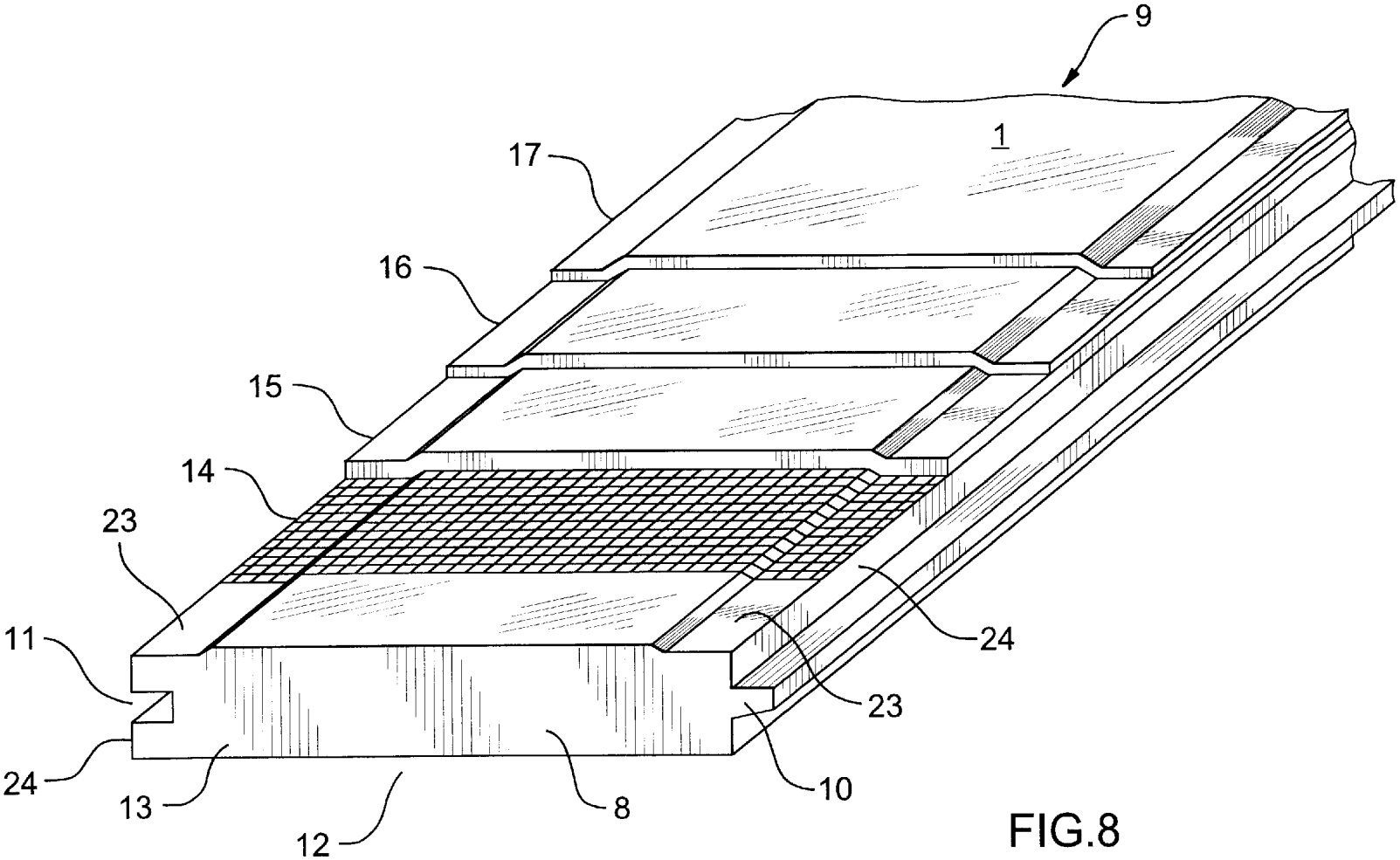
FIG. 8 is a progressively cutaway isometric view of a standard cladding panel showing the foam core, reinforcing mesh, base coating layer, secondary and finish coating layers.

Referring to FIG. 8, the construction of an individual standard panel 1 is shown in progressively stripped away layers for clarity. To provide the exterior insulating finish cladding panel 1 of the invention, an elongate panel 1 includes a core 8 of foam material coated with a weatherproof coating on at least the exterior surface 9.

Interlocking tongue 10 and groove 11 means are provided along both of the longitudinal surfaces for joining the standard panel 1 to a like adjacent panel 1 in a longitudinal joint (as shown in FIG. 2). The tongue 10 and groove 11 secure the panels 1 together to provide a weatherproof and insulating longitudinal joint. Preferably, the interlocking means used have a thermal resistivity approximately equal to the thermal resistivity of the panel 1 core 8 to preserve the insulating value of the finished built up cladding system.

As shown in FIG. 8, the standard panel 1 has a coated exterior surface 9, a preferably uncoated interior surface 12, first and second end surfaces 13 at both ends of the panel 1, and first and second longitudinal side surfaces 24. The finished panel body 1 and the foam core 8 have uniform transverse cross-sectional profiles. The foam core 8 may be extruded to the desired profile or may be cut from stock foam shapes.

The standard panel 1 includes a recess 23 which together with the adjacent panel 1 recess 23 is taped and troweled to produce a flush invisible finished joint. As shown in FIG. 8, the shape of the foam core 8 is generally rectangular in cross section, with a longitudinal recess 23 adjacent each longitudinal side surface 24.

Figure 7:
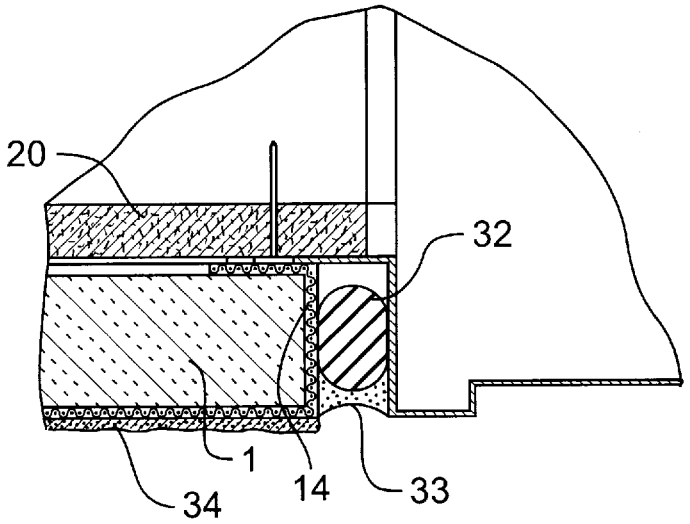
FIG. 7 is a detail view of the expansion joint between a window frame and edge of a trim moulding panel of FIG. 5.

The interior surface 12 is free of weatherproof coating to minimize material costs and weight. The end surfaces 13 are also free of coating since lengths of panels are saw cut to fit the width of the building wall, and since they are protected from weather by the abutting trim members 2, 3, and 4. Alternatively, as indicated in FIG. 7, the cut panel ends around window and door frames may be wrapped with mesh 14 and coated on site to protect the foam core 8.

It will be understood that the abutting trim members 2, 3, and 4 are constructed in a like manner but of course starting with a foam core 8 of an appropriate L-shaped profile. The interior and end surfaces of the trim members 2, 3, and 4 are also free of coating after being saw cut to the desired length. Any exposed surface of the foam core 8 can be coated with stucco on site if considered necessary. Such trim moulding 2, 3, and 4 may be constructed in the form of any desired profile for various building functions such as for example: inside corner moulding; outside corner moulding; window trim or door trim moulding.

The foam core 8 is made of polyurethane foam or other lightweight insulating material. The weatherproof coating provides a stucco appearance. The coating preferably includes a fibreglass reinforcing mesh 14 adhered to the core 8 with pressure sensitive adhesive which aids in bonding the core 8 and cementations layers. A rough base coating 15 is applied in an industrial process either by spraying or extruding through an appropriately shaped forming die. Progressively finer finishes are applied as the secondary coating 16 and finish coating 17 are applied in a like manner.

Figure 3:
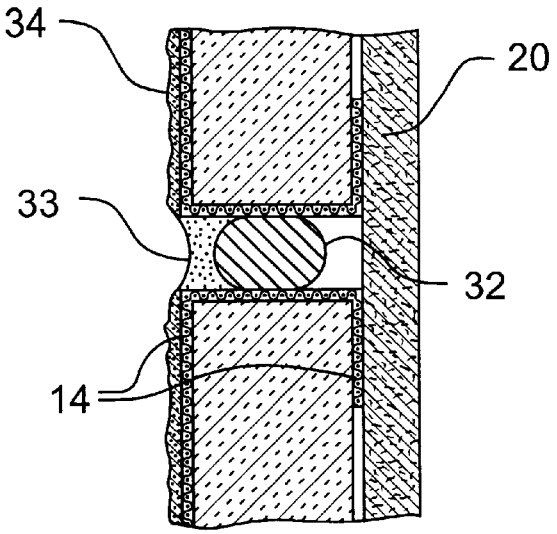
FIG. 3 is a detail of the expansion joint of FIG. 2.
Figure 10:
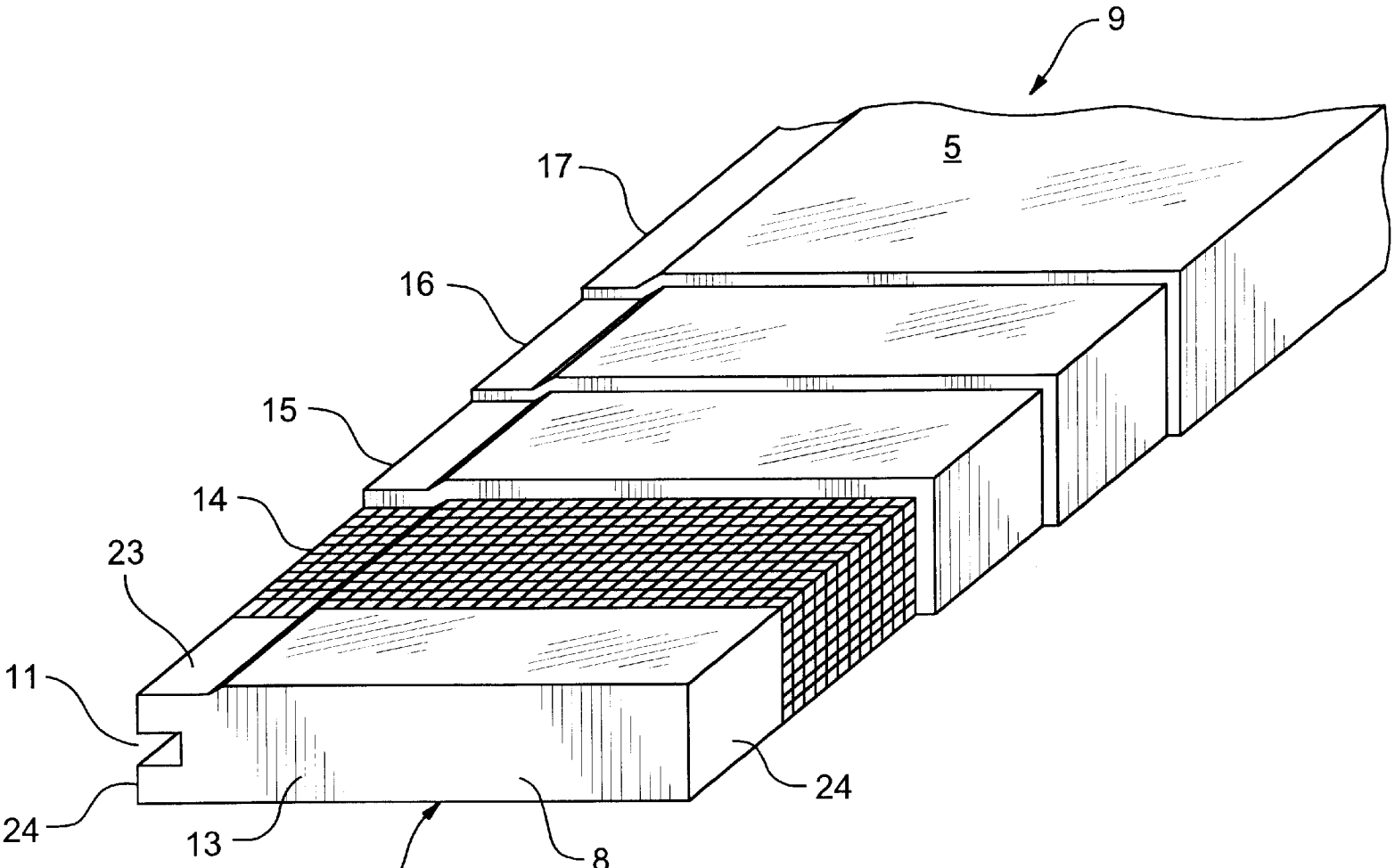
FIG. 10 is a cutaway isometric view of an expansion joint panel similar to FIG. 8.

FIGS. 1 and 2 show an expansion joint 7, a detail of which is illustrated in FIG. 3. Special expansion joint panels 5 are used, the details of which are shown in FIG. 10. The expansion joint panel 5 shown has a groove 11 on one longitudinal side 24 whereas the other side 24 is planar to form the expansion joint 7. All details of the core 8, mesh 14, and coating layers 15, 16 and 17 are the same as the standard panel 1 of FIG. 8. Of course, other expansion joint panels 5 will have a tongue 11 (not shown) on one side 24 with the other side planar to continue the wall pattern, as shown in FIGS. 2 and 3. To begin the wall cladding, as shown in FIG. 2, a starter panel 30 is used at the base of the wall, the details of which are the same as the expansion joint panel 5 except for the addition of the base chamfer 31.

The method of construction in accordance with the invention is generally as follows. A building substrate for the exterior wall is constructed in a conventional manner. The structure shown in FIGS. 2 and 5 comprises a frame 19, and standard exterior sheathing 20 such as plywood, chipboard, fibreboard etc. However any conventional building substrate can be clad in a like manner.

The elongate cladding panels 1, 5, and 30 are shipped to the building site in stock lengths or precut to specified lengths much like lumber. The elongate panels 1, 5, and 30 are cut to the approximate length of the wall surface leaving enough clearance at the cut ends 13 for the appropriate trim 2, 3, and 4 used. The cut panel 1 is then mounted temporarily to the building substrate, for example with temporary fasteners, adhesives, or merely held in place by hand. The exterior faces of the panels 1 are aligned to a predetermined datum such as a vertical plane or curve by shimming between the wall and back of panel if necessary. The panel 1 is then secured to the substrate with fastening means, such as for example, screws 6 with self countersinking washers shown in FIG. 4. By cutting, mounting and affixing a series of like panels 1, 5, and 30 in an interlocking array, the building wall surface is substantially covered.

To complete the panel installation, elongate transverse trim mouldings 2, 3, and 4 are likewise cut, mounted and affixed in position to overlap each exposed end surface of the array of cladding panels 1. Alternatively, as indicated in FIG. 7, the cut panel ends around window and door frames may be wrapped with mesh 14 and coated on site to protect the foam core 8.

Figure 9:
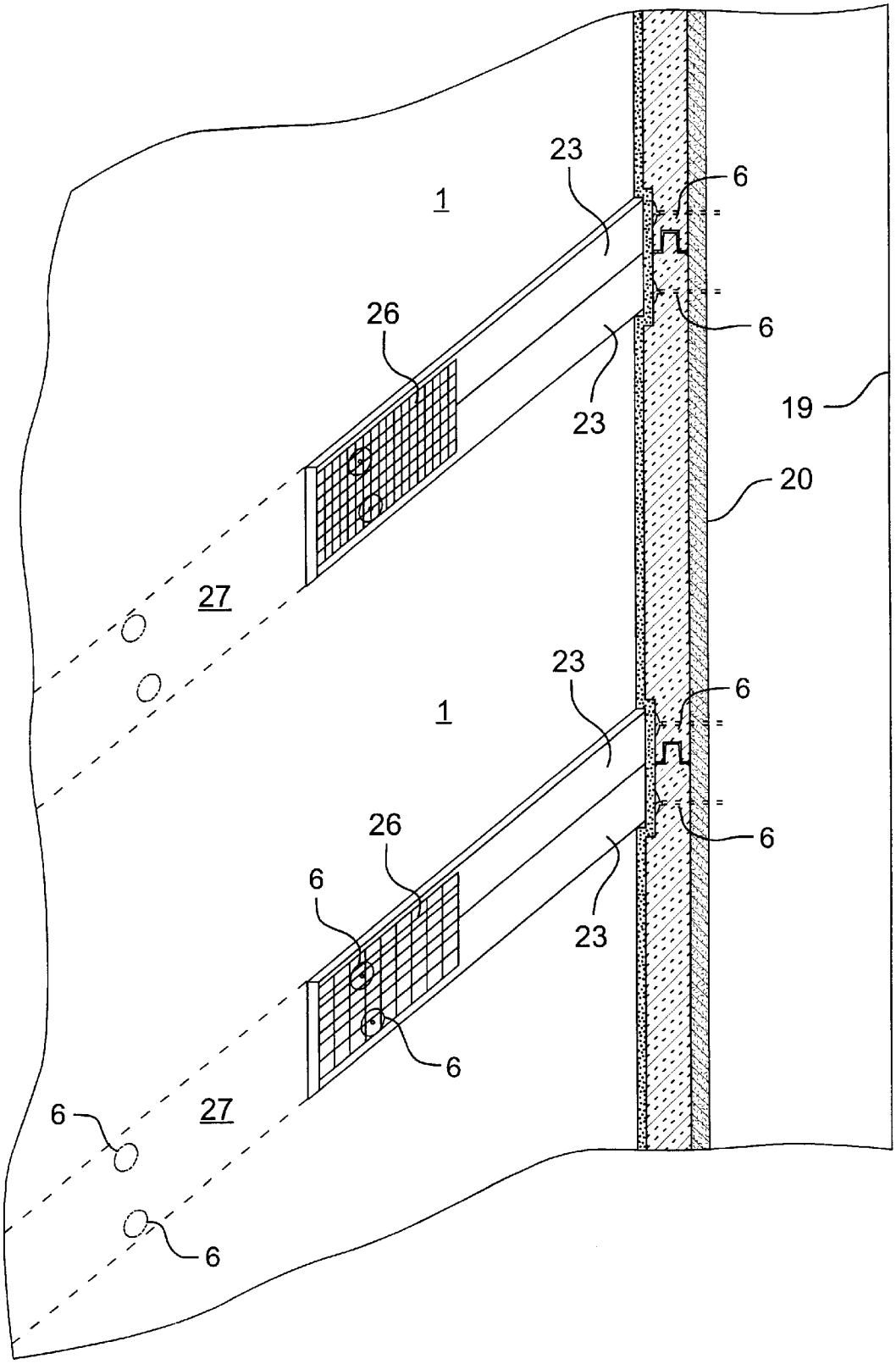
FIG. 9 is a sectional isometric detail view similar to FIG. 2 showing the progressive construction of the flush joint.

Referring to FIG. 9, a flush joint is constructed as follows. To cover the recesses 23 with a flush joint, a longitudinal strip of joint reinforcing mesh 26 is placed spanning across the joint and housed within the adjacent recesses 23 of adjacent panels 1. A joint coating covering of wet stucco material 27 is trowelled in place over the joint mesh 26 and fills the area formed by adjacent recesses 23.

Referring to FIGS. 3 and 7, in the expansion joints 7 and around window or door openings, the rectangular space is stuffed full with rope 32, then an exterior bead of caulking 33 is applied. Expansion and contraction normally expected in cladding structures is thus accommodated in a simple manner.

As indicated in all detail views, FIGS. 3, 4, 6, and 7, if desired after completing all joints, a final finish coating 34 may be applied on site to the entire wall surface.

Figure 4:
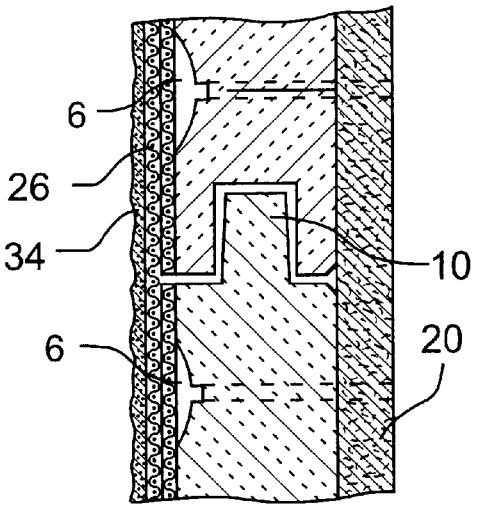
FIG. 4 is a detail of a finished tongue and groove joint with recess filled to a flush finish.

The fastener means by which moulding trim and panels 1 are affixed to the building include mechanical fasteners and adhesives. Preferably both are used together. As shown in FIG. 4, where the interlocking means between the panels 1 comprise a mating tongue 10 and groove 11, one example of a mechanical fastener is shown as a screw 6 with a self countersinking plastic washer. Other mechanical fasteners 6 may be used without departing from the scope of the invention.

It is important to consider when choosing fasteners that a thermally conductive bridge between the substrate and the external ambient atmosphere not be created. In addition, the possibility of fastener corrosion is prevented by enclosing the fasteners in a weatherproof coating of joint compound 27. The snug fitting of the tongue 10 and groove 11 means is generally adequate to provide a moisture proof seal, however it be apparent that caulking or conventional plastic or tar paper sheathing could be used to improve the waterproof character if necessary.

Although the above description and accompanying drawings relate to specific preferred embodiments as presently contemplated by the inventor, it will be understood that the invention in its broad aspect includes mechanical and functional equivalents of the elements described and illustrated.

I claim:

1. An exterior insulating finish panel system, comprising:

an array of elongate cladding panels, each panel having: an exterior surface; an interior surface; first and second longitudinal side surfaces; and first and second end surfaces, each panel having a uniform transverse cross-sectional profile and a core of foam material coated with a weatherproof coating on at least the exterior surface, the array of panels disposed with said longitudinal side surfaces of adjacent panels in the array abutting each other in a side by side progressions;

a tongue and groove joint, disposed along the abutting longitudinal side surfaces of adjacent panels in the array, a longitudinal recess in the exterior surface adjacent each tongue and groove joint;

a layer of joint coating filling the recess and covering each longitudinal joint flush with said external surface;

fastening means for mounting the cladding panels to a substrate without creating a thermally conductive bridge between the substrate and the external ambient atmosphere;

a longitudinal strip of joint reinforcing mesh spanning across each joint and housed within the adjacent recesses of adjacent panels; said joint coating covering said joint mesh and filling said adjacent recesses; and wherein the fastening means comprise screws and self countersinking washers disposed within the longitudinal recesses.

2. A panel system according to claim 1 wherein the interior and end surfaces are substantially free of said weatherproof coating, the weatherproof coating comprises a reinforcing mesh adhered to the core, a three layer coat comprising a stucco mixture comprising a base coating, a secondary coating and a finish coating, and wherein the core comprises polyurethane foam.

3. A panel system according to claim 1 further comprising elongate transverse end trim moulding mounted with a weather tight seal to the end surfaces of said cladding panels, the trim moulding having a uniform transverse cross-sectional profile, and a core of foam material coated with a weatherproof coating on at least an exterior thereof.

4. A panel system according to claim 3 wherein the moulding includes a longitudinal planar edge abutting an end portion of each of a plurality of adjacent cladding panels.

5. A panel system according to claim 4 wherein the moulding is selected from the group consisting of: inside corner moulding; outside corner moulding; window trim moulding; and door trim moulding.

* * * * *